US007343122B2

(12) United States Patent
Itagaki

(10) Patent No.: US 7,343,122 B2
(45) Date of Patent: Mar. 11, 2008

(54) IMAGE FORMING APPARATUS FOR PREVENTING WORM-SHAPED IMAGE IRREGULARITIES

(75) Inventor: Seiko Itagaki, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 155 days.

(21) Appl. No.: 11/295,988

(22) Filed: Dec. 6, 2005

(65) Prior Publication Data

US 2006/0159493 A1 Jul. 20, 2006

(30) Foreign Application Priority Data

Jan. 14, 2005 (JP) ..... 2005-007538
Jan. 17, 2005 (JP) ..... 2005-008844

(51) Int. Cl.
*G03G 15/09* (2006.01)

(52) U.S. Cl. ..... 399/270; 399/55; 399/267

(58) Field of Classification Search ..... 399/267, 399/270, 265, 53, 55; 430/122.1, 122.7, 430/122.8

See application file for complete search history.

(56) References Cited

U.S. PATENT DOCUMENTS 5,799,234 A * 8/1998 Furuya et al. ..... 399/267 X
6,285,841 B1 * 9/2001 Miho ..... 399/55
2002/0114648 A1 * 8/2002 Sugimoto et al. ..... 399/270
2005/0053400 A1 * 3/2005 Ozeki et al. ..... 399/267
2006/0088778 A1 * 4/2006 Itami et al. ..... 430/60

FOREIGN PATENT DOCUMENTS

JP 2004-144788 A * 5/2004

* cited by examiner

*Primary Examiner*—Sophia S. Chen
(74) *Attorney, Agent, or Firm*—Squire, Sanders & Dempsey L.L.P.

(57) ABSTRACT

There is described an image forming apparatus, which prevents an occurrence of worm-shaped image irregularities even in the high-speed developing operation to form a high quality image. In the image forming apparatus, the contact developing employing a two components developer including toner and carrier is conducted in such a manner that the latent image bearing member and the developer bearing member move in directions being opposite relative to each other at a developing region where the latent image bearing member and the developer bearing member are opposed to each other. The frequency of the AC current component and a line velocity of the latent image bearing member fulfill a condition indicated as follow:

$vp/f \leqq 70$ condition 1 where vp (mm/sec) is the line velocity of the latent image bearing member and f (kHz) is the frequency of the AC current component.

7 Claims, 4 Drawing Sheets

IMAGE FORMING APPARATUS FOR PREVENTING WORM-SHAPED IMAGE IRREGULARITIES

This application is based on Japanese Patent Application NO. 2005-007538 filed on Jan. 14, 2005 and NO. 2005-008844 filed on Jan. 17, 2005 in Japanese Patent Office, the entire content of which is hereby incorporated by reference.

BACKGROUND OF THE INVENTION

The present invention relates to an image forming apparatus of an electrophotographic method and more particularly to improvement of a developing device.

In recent years, there is an increasing need for speedup and high image quality for an image forming apparatus of an electrophotographic method. To satisfy the need of speedup, it is necessary to increase the linear speed of a latent image bearing member such as a photosensitive drum, though when the linear speed of the latent image bearing member is increased, various problems arise at the developing step.

At the developing step, in the problems relating to the image quality, a phenomenon that when the linear speed of the latent image bearing member is increased, the width of a fog margin called an operation window, which can be set, is decreased is a main problem.

The fog margin is a potential difference between the charging potential (unexposed part potential of the photosensitive drum) of the latent image bearing member and the DC component of the developing bias potential and the concerned fog margin is generally set to a value of causing neither fog nor carrier adhesion.

And, there are forward development for executing development by moving the latent image bearing member and developer bearing member in the same direction in the developing area where both bearing members are arranged opposite to each other and reverse development for executing development by moving the bearing members in the opposite directions and to widen the operation window of the fog margin and satisfactorily suppress an occurrence of fog and an occurrence of carrier adhesion, the reverse development is advantageous.

Further, in the high-speed development, to ensure the developing performance, the development is executed in the alternating electric field.

As a means for realizing a high-speed image forming apparatus like this, at the developing step, it is advantageous to use the backward developing method and execute development in the alternating electric field. However, even if the means is adopted, it is found that in the high-speed development, worm-shaped image irregularities are easily formed on an image.

Such worm-shaped image irregularities, as shown in FIG. 1, are uneven density generated in a solid image at low density and as a result of pursuit of the cause, it is considered that the uneven density is caused by the following phenomenon.

In the reverse development, the relative speed between the latent image bearing member and the developer bearing member is high, so that the friction between the magnetic brush and the latent image bearing member is increased, thus the latent image bearing member is easily charged by friction, and the latent image bearing member and developer bearing member leave the developing area, and when the gap between the two is expanded, discharge may be caused.

Worm-shaped image irregularities are inferred to be caused by such frictional charge and discharge.

To solve the problem of the image quality at the developing step, many researches have been made until now and many improvements have been proposed.

For example, in Patent Document 1, the linear speed ratio between the latent image bearing member and the developer bearing member is selected, and the intensity of magnetization of the magnetic carrier is made appropriate, thus missing of dot images is prevented.

Further, in Patent Document 2, the relationship between the AC component (Vpp) of the developing bias voltage and the development gap Ds for the difference between the unexposed part potential of the photosensitive drum and the exposure part potential is set appropriately, thus carrier adhesion is prevented.

[Patent Document 1]

Tokkaihei 09-127793 (Japanese Non-Examined Patent Publication)

[Patent Document 2]

Tokkai 2001-5295 (Japanese Non-Examined Patent Publication)

For worm-shaped image irregularities generated in the high-speed development for moving the latent image bearing member such as the photosensitive drum at a high speed, the conventional arts including Patent Documents 1 and 2 explained above are not sufficient measures.

SUMMARY OF THE INVENTION

To overcome the abovementioned drawbacks in conventional image forming apparatus, it is an object of the present invention to provide an image forming apparatus for preventing an occurrence of worm-shaped image irregularities in the high-speed development and forming images of high quality.

Accordingly, to overcome the cited shortcomings, the abovementioned object of the present invention can be attained by image forming apparatus described as follow. (1) An image forming apparatus, comprising: a latent image bearing member; a developer bearing member disposed opposite the latent image bearing member; a magnetic field generating device to generate a magnetic field to be applied onto a surface of the developing bearing member; and a bias voltage power source to generate a developing bias voltage to be applied to a gap between the latent image bearing member and the developer bearing member, in which a DC current component and an AC current component are overlapped with each other; wherein a contact developing employing a two components developer including toner and carrier is conducted in such a manner that the latent image bearing member and the developer bearing member move in directions being opposite relative to each other at a developing region where the latent image bearing member and the developer bearing member are opposed to each other; and wherein a frequency of the AC current component and a line velocity of the latent image bearing member fulfill a first condition indicated as follow:

$$vp/f \leqq 70 \qquad \text{condition 1}$$

where vp (mm/sec): line velocity of the latent image bearing member, f (kHz): frequency of the AC current component.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENTS

<Image Forming Apparatus>

Figure 2:
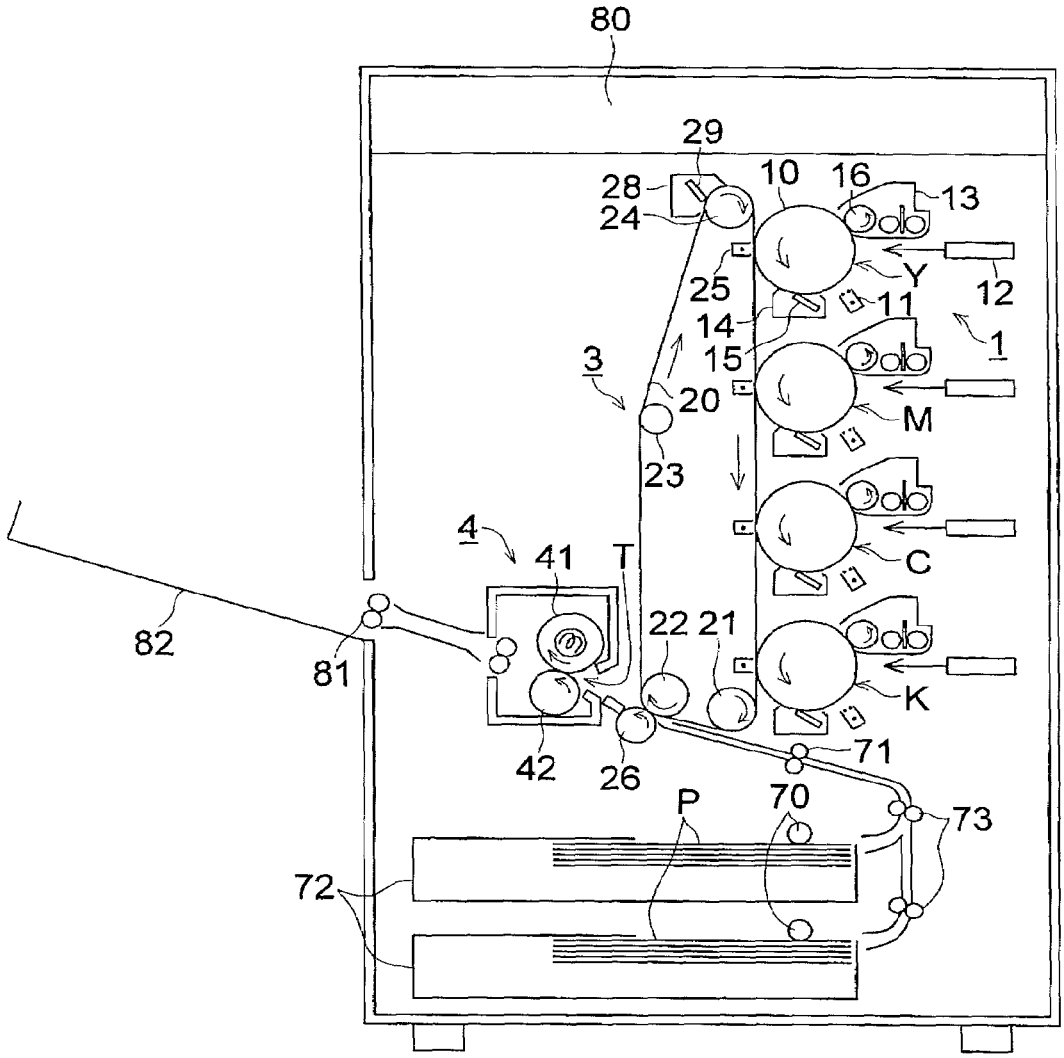
FIG. 2 is a schematic view of the image forming apparatus relating to the embodiment of the present invention.

Hereinafter, the present invention will be explained by referring to an embodiment, though the present invention is not limited to the concerned embodiment. FIG. 2 is a schematic view of the image forming apparatus relating to the embodiment of the present invention.

In FIG. 2, numeral 10 indicates a photosensitive drum as a latent image bearing member, 11 a charger, 12 an exposure, 13 a developing device, 14 a cleaner for cleaning the surface of the photosensitive drum 10, 16 a developing sleeve as a developer bearing member composing the developing device 13, and 20 an intermediate transfer belt. An image forming means 1 is composed of the photosensitive drum 10, charger 11, exposure 12, developing device 13, and cleaner 14 and the mechanical constitution of the image forming means 1 for each color is the same, so that in FIG. 2, the reference numerals are assigned to the components of only the Y (yellow) series and for the components of M (magenta), C (cyan), and K (black), the reference numerals are omitted. The charger 11 and exposure 12 compose a latent image forming means for forming an electrostatic latent image on the latent image bearing member.

The image forming means 1 for each color, in the traveling direction of the intermediate transfer 20, is arranged in the order of Y, M, C, and K and each photosensitive drum 10 is in contact with the stretched surface of the intermediate transfer belt 20 and rotates at the contact in the same direction as the traveling direction of the intermediate transfer belt 20 and at the same linear speed.

The intermediate transfer belt 20 is stretched and suspended by a drive roller 21, an earthing roller 22, a tension roller 23, and a driven roller 24 and these rollers and the intermediate transfer belt 20, transfer device 25, and cleaner 28 compose a belt unit 3.

The intermediate transfer belt 20 moves by the rotation of the drive roller 21 by a drive motor not drawn.

Figure 1:
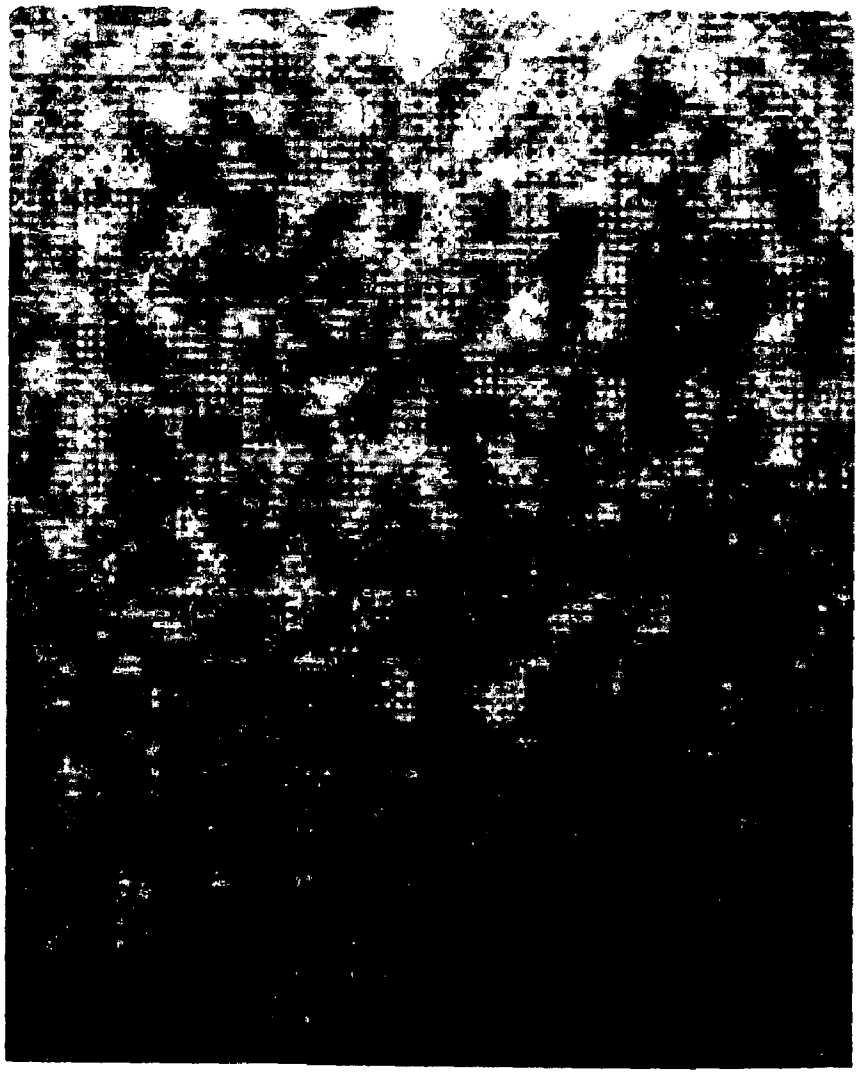
FIG. 1 shows an example of a reproduced image in which worm-shaped image irregularities are generated.

The photosensitive drum 10 is, for example, composed of a photosensitive layer such as a conductive layer, an a-Si layer, or an organic photoconductor (OPC) which is formed on the outer periphery of a cylindrical metallic base made of an aluminum material and rotates in the counterclockwise direction indicated by the arrow in FIG. 1 in the state that the conductive layer is grounded.

An electric signal corresponding to image data from a reader 80 or an external device is converted to an optical signal by an image forming laser and an image is exposed on the photosensitive drum 10 by the exposure 12.

The developing device 13 has the developing sleeve 16 formed by a cylindrical nonmagnetic stainless steel or aluminum material which keeps a predetermined interval to the peripheral surface of the photosensitive drum 10 and rotates in the opposite direction of the rotational direction of the photosensitive drum 10 at the closest position. Further, the developing device 13 will be described later in detail.

The intermediate transfer belt 20 is an endless belt with a volume resistivity of $10^6$ to $10^{12}$ Ω cm and it is a semiconductive seamless belt with a thickness of 0.015 to 0.05 mm in which a conductive material is dispersed in engineering plastics such as modified polyimide, thermosetting polyimide, ethylene tetrafluoroethylene copolymer, polyvinylidene fluoride, or nylon alloy.

Numeral 25 indicates a transfer device, which has a function for transferring a toner image, which is applied with a direct current of the reverse polarity to the toner and is formed on the photosensitive drum 10, onto the intermediate transfer belt 20. For the transfer device 25, in addition to a corona discharger, a transfer roller can be used.

Numeral 26 indicates a transfer device composed of a transfer roller which can make contact with and separate from the earthing roller 22 and retransfers a toner image formed on the intermediate transfer belt 20 to a recording material P.

Numeral 28 indicates a cleaner having a cleaning blade 29 and is installed opposite to the driven roller 24 across the intermediate transfer belt 20. After transferring the toner image to the recording material P, the intermediate transfer belt 20 passes the cleaner 28 and is cleaned toner remaining on the peripheral surface thereof by the cleaning blade 29.

Numeral 70 indicates a paper feed roller, 71 a timing roller, 72 paper cassettes, and 73 conveying rollers.

Numeral 4 indicates a fixing device, which heats, pressurizes, and fixes the toner image on the recording material P, which is transferred from the intermediate transfer belt 20, in a nipping section T formed by a heat roller 41 and a press roller 42. Numeral 81 indicates paper discharge rollers, which discharge the fixed recording material to a paper discharge tray 82.

<Developing Device>

Next, the developing device will be explained.

As a developing device, a developing device using a two-component developer composed of main components of a carrier and toner is used, though a two-component developing device using toner with a small particle diameter is preferable. Further, the developing device can use both regular development and reverse development, though the reverse development of applying the developing bias of the same polarity as that of the charge of the photosensitive drum 10 to the developing sleeve 16 and using toner charged at the same polarity as that of the charge of the photosensitive drum for development is preferable. In this embodiment, the reverse development using negatively charged toner is used for development.

Toner with a small particle diameter such as a mean volume particle diameter of 4.5 μm to 6 μm is preferable.

The mean volume particle diameter is measured by the method indicated below.

The mean volume particle diameter is measured and calculated using a device composed of a Coulter Multisizer II (manufactured by Beckman Coulter, Inc.) connected to a data processing computer system (manufactured by Beckman Coulter, Inc.).

The measuring procedure is that toner of 0.02 g is allowed to become accustomed to a surface-active agent of 20 ml (for the purpose of dispersion of toner, for example, a surface-active agent solution in which a neutral detergent including a surface-active agent component is diluted to 10 times in pure water) and then is subject to ultrasonic dispersion for one minute, thus a toner dispersed liquid is prepared. The toner dispersed liquid is injected into a beaker containing ISOTON II (manufactured by Beckman Coulter, Inc.) in the sample stand up to measurement density of 5% to 10% by a pipette and the particle diameter is measured by setting the count of a measuring instrument to 30000. Further, the aperture diameter of the Coulter Multisizer is 100 μm.

By such toner with a small particle diameter, a high-quality image of high resolution can be formed. In toner with a mean volume particle diameter larger than 6 μm, the characteristic of high image quality is reduced.

When toner with a mean volume particle diameter smaller than 4.5 μm is used, the image quality is easily lowered due to fog.

For toner with a small particle diameter as mentioned above, it is desirable to use polymerized toner.

The polymerized toner means toner obtained by generating toner binder resin and forming the toner shape by polymerization of the raw monomer of the binder resin or prepolymer and the subsequent chemical treatment. More concretely, it means toner obtained via the polymerization reaction such as suspension polymerization or emulsion polymerization and the fusing step of particles executed thereafter as required. The polymerized toner is manufactured by uniformly dispersing the raw monomer or prepolymer in a water series medium and then polymerizing it, so that toner in a uniform particle size distribution and shape can be obtained.

Concretely, the polymerized toner can be manufactured by the suspension polymerization method or by a method of emulsion-polymerizing a monomer in a water series medium solution added with an emulsifier, manufacturing polymerized fine particles, and thereafter adding and associating an organic solvent medium and a flocculant. In addition, a method, at time of association, of mixing and associating a dispersion liquid such as a release agent and a coloring agent necessary for the toner constitution and a method of dispersing the toner constituent components such as the release agent and coloring agent in the monomer and then emulsion-polymerizing them may be cited. Here, the association is referred to as fusion of a plurality of resin particles and coloring agent particles.

For magnetic particles of the magnetic carrier, a conventional well-known material such as a metal of iron, ferrite, or magnesite, or an alloy of any of those metals and a metal of aluminum or lead is used. Particularly, ferrite particles are preferable.

For the carrier, magnetic particles, magnetic particles additionally covered with resin, or the so-called resin dispersed carrier composed of magnetic particles dispersed in resin is used, though a carrier composed of magnetic particles covered with resin is preferable. The coating resin composition is not restricted particularly and for example, olefin resin, styrene resin, styrene-acrylic resin, silicone resin, ester resin, or fluorine containing polymer resin is used. Further, the resin for composing a resin dispersed carrier is not restricted particularly, and a well-known resin can be used, and for example, styrene-acrylic resin, polyester resin, fluorine resin, or phenolic resin can be used.

To realize high-speed development, to expedite start-up of charging of toner, a carrier of a comparatively low resistance is preferable. Namely, a carrier having a resistance of $0.09\times10^9$ to $2\times10^9$ Ω measured by the following method is used.

Figure 3:
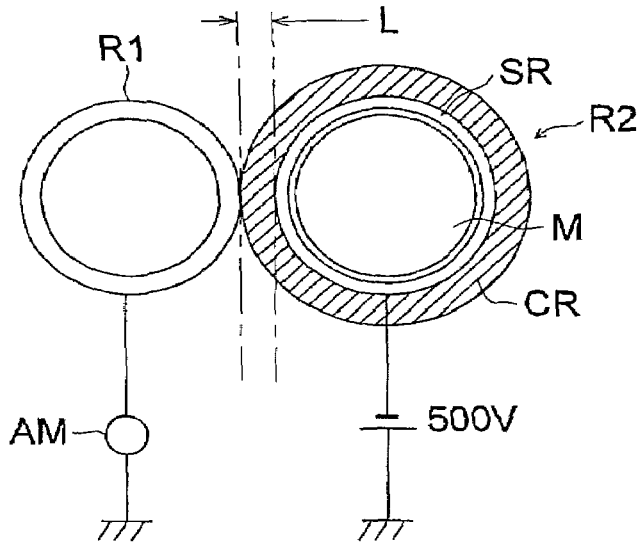
FIG. 3 shows a measuring instrument of the carrier resistance.

FIG. 3 shows a measuring instrument of the carrier resistance.

Opposite to an aluminum cylinder R1, a magnet roll R2 is arranged and an interval L between the cylinder R1 and the outer periphery of the magnet roll R2 composed of a conductive sleeve SR and a fixed magnet M is set to 0.5 mm. On the surface of the magnet roll R2, a carrier layer of 800 to 1000 g/cm$^2$ is formed, and the carrier layer makes slight contact with the cylinder R1, and a DC voltage of 500 V is applied to the conductive sleeve SR (with a diameter of 35 ϕ and a length of 55 mm), and the current at that time is measured by an ammeter AM, and the resistance of the carrier CR is detected.

The carrier having a comparatively low resistance as mentioned above is obtained by reducing the resistance of the resin-covered layer by a means of impregnating carbon black into the resin-covered layer.

Figure 4:
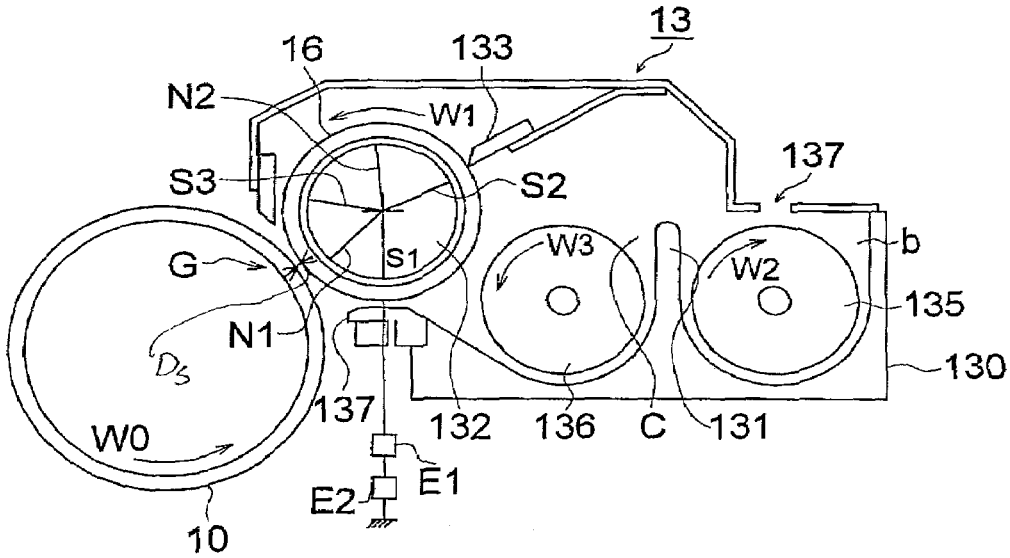
FIG. 4 is a cross sectional view of a developing device.

FIG. 4 is a cross sectional view of the developing device 13.

In FIG. 4, numeral 130 indicates a casing for storing a two-component developer composed of toner and a carrier and inside the developing sleeve 16 as a developer bearing member, a fixed magnet roller 132 as a magnetic field generating means is installed. The magnet roll 132 has two north poles indicated by N1 and N2 and three south poles indicated by S1 to S3.

The magnetization center of the magnet roll 132, that is, the center of each magnetic pole in the magnetization direction almost coincides with the rotational center of the developing sleeve 16.

The pole N1 is a developing pole for forming a magnetic brush of the developer in the developing area G where the developing sleeve 16 is opposite to the photosensitive drum 10, and the poles S1 and S2 are magnetic poles for forming a repulsion magnetic field, and by the repulsion magnetic field, the developer on the developing sleeve 16 is separated. The pole S1 is a downstream side magnetic pole formed right on the downstream side of the pole N1 which is a developing pole. The pole S2 is a layer forming pole for adhering the developer to the developing sleeve 16 and forming a layer. The developing sleeve 16 rotates as indicated by an arrow W1, thereby conveys the developer, and S2, N2, S3, and N1 sequentially formed in the conveying direction form a conveying magnetic pole row where the different poles are arranged alternately, and the developer is conveyed by the conveying magnetic pole row and is supplied to the developing area G. Between the pole S2 and the pole N2, a control member 133 is arranged opposite to the developing sleeve 16, and by the control action by the pole S2 as a layer forming magnetic pole and the control member 133, the amount of the developer conveyed on the developing sleeve 16 is controlled, and a uniform developer layer is formed on the developing sleeve 16.

Numerals 135 and 136 indicate screws for stirring and conveying the developer.

Toner, in FIG. 4, is supplied from an opening indicated by numeral 137 into the developing device 13.

A stirring chamber b where the screw 135 is arranged and a supply and collection chamber c where the screw 136 is arranged are separated by a partition 131 and in the partition 131, although not drawn, passing holes through which the developer passes are formed at the ends of the screws 135 and 136 in the direction of each rotation shaft.

In the housing 130, an opening is formed at the part where the developing sleeve 16 is opposite to the photosensitive drum 10 and the developing area G is formed.

The development is executed as indicated below.

In FIG. 4, the photosensitive drum 10 rotates as indicated by an arrow W0, the developing sleeve 16 as indicated by an arrow W1, the screw 135 as indicated by an arrow W2, and the screw 136 as indicated by an arrow W3, and the developer is conveyed in the order of the screw 135, the screw 136, and the developing sleeve 16, and the development is executed in the developing area G. As shown in the drawing, in the developing area G, the photosensitive drum 10 and the developing sleeve 16 move in the opposite directions and the reverse development is executed.

By the reverse development, a high-density toner image can be formed and carrier adhesion can be suppressed. Further, by the reverse development, the operation window of the fog margin which is a difference between the charging potential of the photosensitive drum 10 and the DC component of the developing bias, that is, the fog margin for executing satisfactory development for generating fog and carrier adhesion is widened.

To the developing sleeve 16, a developing bias voltage generated by superimposing a DC voltage to an AC voltage by bias power sources E1 and E2 is applied. The bias power source E1 is a power source of the DC component and the bias power source E2 is a power source of the AC component.

In the developing device 13, at the high-speed image forming step, that is, at the image forming step of moving the photosensitive drum 10 at a high linear speed and executing development, by satisfying the following condition, a high-quality image having sufficient highest density and sufficiently reducing the image quality lowering phenomenon such as fog, carrier adhesion, and worm-shaped image irregularities can be formed.

Particularly, when moving the latent image bearing member at a high speed, for example, at a linear speed of the photosensitive drum 10 of 250 mm/s or more and executing development, it is difficult to prevent a lowering of the image quality starting with worm-shaped image irregularities. However, by satisfying the condition indicated below, a lowering of the image quality is prevented and a high-quality image can be formed. Further, the linear speed of the latent image bearing member is increased up to about 450 mm/s and image forming can be executed, though in the present invention, higher-speed development can be executed.

Condition 1 (Condition in the present invention)

$$vp/f \leqq 70$$

vp indicates a linear speed (mm/s) of the photosensitive drum 10 and f indicates a frequency (kHz) of the AC component of the developing bias.

When the relative speed between the latent image bearing member and the developer bearing member is high, the friction between the magnetic brush and the latent image bearing member is increased, and the latent image bearing member is easily charged by friction, and the latent image bearing member and developer bearing member leave the developing area, and when the gap between the two is expanded, discharge may be caused.

In the reverse development for moving the photosensitive drum 10 and the developing sleeve 16 in the opposite directions in the developing area and executing development, the relative speed difference between the photosensitive drum 10 and the developing sleeve 16 is increased, so that worm-shaped image irregularities are easily generated due to the frictional charging and discharging caused under the contact development. However, when development is executed under Condition 1, generation of worm-shaped image irregularities can be suppressed sufficiently.

Here, the contact development is of a developing method of making the magnetic brush contact with the photosensitive drum 10 and executing development and it is development executed by setting conditions so as to control the relationship between the development gap Ds and the height h of the bristles of the magnetic brush to h>Ds.

Figure 5:
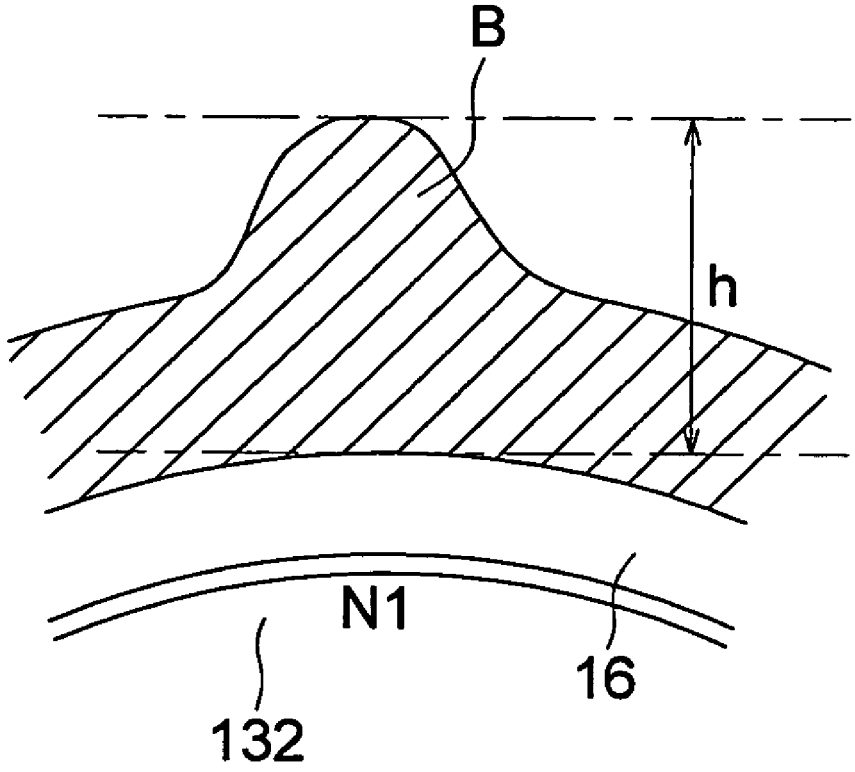
FIG. 5 is a cross sectional view of a magnetic blush.

The height h of the bristles of the magnetic brush, as shown in FIG. 5, is the highest value of the magnetic brush B of the developer formed on the developing sleeve 16 by the pole N1 which is a developing pole. The highest value h is measured by rotating the developing sleeve 16 when the photosensitive drum 10 is separated from the developing sleeve 16 and the magnet roll 132, forming the magnetic brush B, and observing the bristles of the magnetic brush B not controlled by the photosensitive drum 10. Further, the developing gap Ds is the shortest distance between the photosensitive drum 10 and the developing sleeve 16.

When vp/f exceeds 70, worm-shaped image irregularities are easily generated.

Condition 2 to Condition 7 indicated below are preferable conditions.

$$0 < h - Ds \leqq 0.3 \text{ mm} \qquad \text{Condition 2}$$

Condition 2 means contact development for executing development by making the magnetic brush contact with photosensitive drum 10. When h−Ds is negative, that is, the magnetic brush is not in contact with the photosensitive drum 10, sufficient maximum density cannot be obtained. Further, when h−Ds is larger than 0.3 mm, non-uniform density due to rubbing of the magnetic brush, carrier adhesion, and clogging of the developer at the developing nipping section in the developing area are easily caused.

$$40 \leqq vp/f \qquad \text{Condition 3}$$

When vp/f is smaller than 40, a tendency of unsatisfactory reproducibility of fine lines appears.

$$1.25 \leqq (f \cdot Ds)/Vac \leqq 1.6 \qquad \text{Condition 4}$$

In Condition 4, Vac indicates a voltage (peak to peak voltage) (kV) of the AC component of the developing bias voltage, which is the output voltage (peak to peak voltage) of the power source E2 shown in FIG. 4.

Condition 4 is a condition for making the reproducibility of fine lines satisfactory and when (f·Ds)/Vac exceeds 1.6, the reproducibility of fine lines is lowered. Further, when (f·Ds)/Vac is lower than 1.25, fog occurs easily.

$$(Vh + \Delta Vdc)/Ds \leqq 3.8 \qquad \text{Condition 5}$$

In Condition 5, Vh indicates a peak value of the part of the AC component of the developing bias voltage contributing to development and Vh=(½)Vac. Further, ΔVdc indicates a fog margin and it is an absolute value of the difference between the charging potential of the photosensitive drum 10, that is, the charging potential VL of the unexposed part and the potential Vdc of the DC component of the developing bias potential, that is, $\Delta Vdc = |VL - Vdc|$.

Condition 5 is a condition for preventing carrier adhesion and preventing discharge and leakage through the magnetic brush. When (Vh+ΔVdc)/Ds is larger than 3.8, images are easily missed due to carrier adhesion, discharge, or leakage.

$$vp \geqq 250 \qquad \text{Condition 6}$$

Condition 6 is a condition for high-speed image forming.

$$1.5 \leqq vs/vp \leqq 3.0 \qquad \text{Condition 7}$$

In Condition 7, vs indicates a linear speed of the developer bearing member and in FIG. 4, it is a linear speed of the developing sleeve 16. Further, although the photosensitive drum 10 and the developing sleeve 16 move mutually in the opposite directions, the movements in the opposite directions are positive respectively.

Condition 7 is a condition for ensuring the developing performance of the high-speed development and obtaining images of sufficient highest density, and when vs/vp is lower than 1.5, the developing performance is lowered, and sufficient highest density can be hardly obtained. Further, when vs/vp is larger than 3.0, uneven density and scattering of the developer are generated easily.

Embodiment

In FIG. 4, the linear speed of the photosensitive is set to vp=300 mm/s, and the ratio of the speed of the photosensitive drum 10 to the speed of the developing sleeve 16 is set to vs/vp=1.8, and as shown in Table 1, images are formed by changing the parameters relating to the conditions aforementioned, and as shown in Table 1, worm-shaped image irregularities, reproducibility of fine lines, fog, and others are evaluated.

Furthermore, "-" in the evaluation column indicates impossibility of evaluation due to inferior image quality.

As shown in Table 1, in the experimental examples showing vp/f of 70 or less, satisfactory images are formed, while in the experimental examples showing vp/f of more than 70, worm-shaped image irregularities are generated. Further, when vp/f is less than 40, the reproducibility of fine lines is lowered slightly, and carrier adhesion and discharge marks are generated in the case Vac is increased to solve the lowered reproducibility.

Further, in the experimental examples showing a higher value of (f·Ds)/Vac than 1.6, the reproducibility of fine lines is not good and in the experimental examples showing a lower value of (f·Ds)/Vac than 1.25, fog is easily generated.

Further, in the experimental examples showing (Vp+ΔVdc)/Ds of more than 3.8, images are easily missed due to carrier adhesion, discharge, or leakage.

TABLE 1

| No. | H − Ds | f | Vp/f | Ds | Vac | ΔVdc | Vac/Ds | f · DS/Vac | (Vp + ΔVdc)/Ds | *1 | *2 | Fog | *3 | Discharge mark |
|---|---|---|---|---|---|---|---|---|---|---|---|---|---|---|
| 1 | 0.2 | 8 | 37.5 | 0.25 | 1.6 | 0.4 | 6.4 | 1.25 | 4.8 | Go | Go | Ba | Ba | Ba |
| 2 | 0.2 | 8 | 37.5 | 0.25 | 1.4 | 0.4 | 5.6 | 1.43 | 4.4 | Go | Pa | Go | Ba | Ba |
| 3 | 0.2 | 7 | 42.9 | 0.25 | 1.6 | 0.4 | 6.4 | 1.09 | 4.8 | Go | Go | Ba | Ba | Ba |
| 4 | 0.2 | 7 | 42.9 | 0.25 | 1.4 | 0.3 | 5.6 | 1.25 | 4 | Go | Go | Go | Ba | Ba |
| 5 | 0.2 | 7 | 42.9 | 0.25 | 1.4 | 0.25 | 5.6 | 1.25 | 3.8 | Go | Go | Go | Go | Go |
| 6 | 0.2 | 7 | 42.9 | 0.25 | 1.1 | 0.4 | 4.4 | 1.59 | 3.8 | Go | Go | Go | Go | Go |
| 7 | 0.2 | 7 | 42.9 | 0.25 | 1 | 0.4 | 4 | 1.75 | 3.6 | Go | Ba | Go | Go | Go |
| 8 | 0.2 | 7 | 42.9 | 0.3 | 1.4 | 0.55 | 4.7 | 1.5 | 4.2 | Go | Go | Go | Ba | Ba |
| 9 | 0.2 | 7 | 42.9 | 0.3 | 1.4 | 0.5 | 4.7 | 1.5 | 4 | Go | Go | Go | Ba | Ba |
| 10 | 0.2 | 7 | 42.9 | 0.3 | 1 | 0.4 | 3.3 | 2.1 | 3 | Go | Ba | Go | Go | Go |
| 11 | 0.2 | 5 | 60.0 | 0.25 | 1.6 | 0.4 | 6.4 | 0.78 | 4.8 | Go | Go | Ba | Ba | Ba |
| 12 | 0.2 | 5 | 60.0 | 0.25 | 1.4 | 0.4 | 5.6 | 0.89 | 4.4 | Go | Go | Ba | Ba | Ba |
| 13 | 0.2 | 5 | 60.0 | 0.25 | 1 | 0.45 | 4 | 1.25 | 3.8 | Go | Go | Go | Go | Go |
| 14 | 0.2 | 5 | 60.0 | 0.25 | 1 | 0.5 | 4 | 1.25 | 4 | Go | Go | Go | Ba | Ba |
| 15 | 0.2 | 5 | 60.0 | 0.25 | 0.6 | 0.45 | 2.4 | 2.08 | 3 | Go | Ba | Go | Go | Go |
| 16 | 0.2 | 5 | 60.0 | 0.3 | 1.4 | 0.45 | 4.7 | 1.07 | 3.8 | Go | Go | Ba | Ba | Ba |
| 17 | 0.2 | 5 | 60.0 | 0.3 | 1 | 0.45 | 3.3 | 1.5 | 3.2 | Go | Go | Go | Go | Go |
| 18 | 0.2 | 5 | 60.0 | 0.3 | 0.6 | 0.45 | 2 | 2.5 | 2.5 | Go | Ba | Go | Go | Go |
| 19 | 0.2 | 4 | 75.0 | 0.25 | 1 | 0.4 | 4 | 1 | 3.6 | Pa | Go | Ba | Go | Go |
| 20 | 0.2 | 4 | 75.0 | 0.25 | 0.6 | 0.4 | 2.4 | 1.67 | 2.8 | Pa | Pa | Go | Go | Go |
| 21 | 0.2 | 4 | 75.0 | 0.3 | 1.4 | 0.4 | 4.7 | 0.86 | 3.7 | Pa | Go | Ba | Go | Go |
| 22 | 0.2 | 4 | 75.0 | 0.3 | 1 | 0.4 | 3.3 | 1.2 | 3 | Pa | Go | Pa | Go | Go |
| 23 | 0.2 | 4 | 75.0 | 0.3 | 0.6 | 0.4 | 2 | 2 | 2.3 | Pa | Ba | Go | Go | Go |
| 24 | 0.2 | 3 | 100.0 | 0.25 | 1 | 0.4 | 4 | 0.75 | 3.6 | Ba | Go | Pa | Go | Go |
| 25 | 0.2 | 3 | 100.0 | 0.25 | 0.6 | 0.4 | 2.4 | 1.25 | 2.8 | Ba | Go | Go | Go | Go |
| 26 | 0.2 | 3 | 100.0 | 0.3 | 1.4 | 0.4 | 4.7 | 0.64 | 3.7 | Ba | Go | Ba | Go | Go |
| 27 | 0.2 | 3 | 100.0 | 0.3 | 1 | 0.4 | 3.3 | 0.9 | 3 | Ba | Go | Ba | Go | Go |
| 28 | 0.2 | 3 | 100.0 | 0.3 | 0.6 | 0.4 | 2 | 1.5 | 2.3 | Ba | Go | Go | Go | Go |
| 29 | −0.05 | 7 | 42.9 | 0.25 | 1.4 | 0.25 | 5.6 | 1.25 | 3.8 | Go | Ba | Go | Go | Go |
| | | | | | Insufficient image density | | | | | | | | | |
| 30 | 0.35 | 7 | 42.9 | 0.25 | 1.4 | 0.25 | 5.6 | 1.25 | 3.8 | — | — | Ba | Ba | Go |
| | | | | | | Uneven density | | | | | | | | |

*1: Worm-shaped irregularities,
*2: Reproducibility of fine lines,
*3: Carrier adhesion to solid part (HH),
Go: Good,
Pa: Passable,
Ba: Bad In Table 1, ΔVdc indicates a fog margin and ΔVdc=VL−Vdc is held, where VL indicates a charging potential of the unexposed part of the photosensitive drum 10 and Vdc indicates a voltage of the DC component of the developing bias voltage.

Insufficient image density in Experiment No. 29 indicates that although an image is formed, the density is insufficient and uneven density in Experiment No. 30 indicates that uneven density is caused by rubbing of the magnetic brush.

While the preferred embodiments of the present invention have been described using specific term, such description is for illustrative purpose only, and it is to be understood that changes and variations may be made without departing from the spirit and scope of the appended claims.

As described in the foregoing, the present invention realizes an image forming apparatus, even in high-speed image forming, for sufficiently reducing an occurrence of worm-shaped image irregularities and forming images of high quality.

While the preferred embodiments of the present invention have been described using specific term, such description is for illustrative purpose only, and it is to be understood that changes and variations may be made without departing from the spirit and scope of the appended claims.

What is claimed is:

1. An image forming apparatus, comprising:

a latent image bearing member;

a developer bearing member disposed opposite said latent image bearing member;

a magnetic field generating device to generate a magnetic field to be applied onto a surface of said developer bearing member; and a bias voltage power source to generate a developing bias voltage to be applied to a gap between said latent image bearing member and said developer bearing member, in which a DC current component and an AC current component are overlapped with each other;

wherein a contact developing employing a two components developer including toner and carrier is conducted in such a manner that said latent image bearing member and said developer bearing member move in directions being opposite relative to each other at a developing region where said latent image bearing member and said developer bearing member are opposed to each other; and wherein a frequency of said AC current component and a line velocity of said latent image bearing member fulfill a first condition indicated as follow:

$$vp/f \leqq 70 \qquad \text{condition 1}$$

where vp (mm/see): line velocity of said latent image bearing member, f (kHz): frequency of said AC current component; and wherein a peak value of said AC current component effective for a developing operation, a developing gap, being a shortest distance between said latent image bearing member and said developer bearing member, and a fog margin fulfill a second condition indicated as follow:

$$(Vh+Vdc)/Ds \leqq 3.8 \qquad \text{condition 2}$$

where Vh (kV): peak value of said AC current component (Vh=Vac/2, Vac: peak-to-peak voltage)

AVdc: fog margin

Ds (mm): developing gap.

2. The image forming apparatus of claim 1, wherein a developing gap, being a shortest distance between said latent image bearing member and said developer bearing member, and a maximum height of bristles of a magnetic brush formed by said two components developer at said developing region fulfill a third condition indicated as follow:

$$0 < h - Ds \leqq 0.3 \text{ mm} \qquad \text{condition 3}$$

where h (mm): maximum height of bristles of said magnetic brush.

3. The image forming apparatus of claim 1, wherein said frequency and said line velocity fulfill a third condition indicated as follow:

$$40 \leqq vp/f \qquad \text{condition 3.}$$

4. The image forming apparatus of claim 1, wherein said frequency, a peak-to-peak voltage of said AC current component and a developing gap, being a shortest distance between said latent image bearing member and said developer bearing member, fulfill a third condition indicated as follow:

$$1.25 \leqq (f \cdot Ds)/Vac \leqq 1.6 \qquad \text{condition 3}$$

where

Vac (kV): peak-to-peak voltage of said AC current component.

5. The image forming apparatus of claim 1, wherein said line velocity of said latent image bearing member fulfill a third condition indicated as follow:

$$Vp \geqq 250 \qquad \text{condition 3.}$$

6. The image forming apparatus of claim 1, wherein a line velocity of said developer bearing member and said line velocity of said latent image bearing member fulfill a third condition indicated as follow:

$$1.5\ Svs/vp \leqq 3.0 \qquad \text{condition 3}$$

where vs (mm/sec): line velocity of said developer bearing member.

7. The image forming apparatus of claim 1, wherein said carrier are made by coating each of magnetic particles with a resin material.

* * * * *